US006580205B2

(12) United States Patent
Park

(10) Patent No.: US 6,580,205 B2
(45) Date of Patent: Jun. 17, 2003

(54) FRAME ASSEMBLY OF SHADOW MASK IN FLAT BRAUN TUBE

(75) Inventor: Soo Kil Park, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 364 days.

(21) Appl. No.: 09/732,904

(22) Filed: Dec. 11, 2000

(65) Prior Publication Data

US 2001/0043036 A1 Nov. 22, 2001

(30) Foreign Application Priority Data

Jan. 12, 2000 (KR) ..... 2000-1395

(51) Int. Cl.[7] ..... H01J 29/80
(52) U.S. Cl. ..... 313/407; 313/402
(58) Field of Search ..... 313/407, 402, 313/404, 408

(56) References Cited

U.S. PATENT DOCUMENTS 5,063,325 A * 11/1991 Ragland, Jr. ..... 313/405
5,982,085 A * 11/1999 Lakshmanan et al. ..... 313/407
2002/0180328 A1 * 12/2002 Hwang ..... 313/402

* cited by examiner

*Primary Examiner*—Jay Patidar
(74) *Attorney, Agent, or Firm*—Birch, Stewart, Kolasch & Birch, LLP

(57) ABSTRACT

Frame assembly of a shadow mask in a flat Braun tube, in which a stress on a shadow mask is reduced for minimizing creep during an elevated temperature process, and a low tension on the shadow mask is corrected effectively during operation of a flat Braun tube after the elevated temperature process, for preventing deterioration of a color purity caused by deterioration of howling and doming, including a main frame fitted to the shadow mask, sub-frames connected between both ends of the main frame, and a thermal compensating plate fitted to a bottom of the sub-frames, wherein, first, a ratio(h/t) of a height 'h' of the sub-frame to a thickness 't' of the thermal compensating plate is within a range of 4~8, second, a ratio(b/b') of a width 'b' of the sub-frame to a width 'b'' of the thermal compensating plate is within a range of 0.8~1.3, and, third, a ratio(l/l') of a length 'l' of the sub-frame having the thermal compensating plate fitted thereto to a length 'l'' of the thermal compensating plate is within a range of 0.8~1.3.

4 Claims, 6 Drawing Sheets

FRAME ASSEMBLY OF SHADOW MASK IN FLAT BRAUN TUBE

BACKGROUND OF THE INVENTION

1. Field of the Invention

The present invention relates to a frame assembly of a shadow mask in a flat Braun tube, and, more particularly, to a frame assembly of a shadow mask in a flat Braun tube, in which a stress on a shadow mask is reduced for minimizing creep during an elevated temperature process, and a low tension on the shadow mask is corrected effectively during operation of a flat Braun tube after the elevated temperature process, for preventing deterioration of a color purity caused by deterioration of howling and doming.

2. Background of the Related Art

FIG. 1 illustrates a side view with a partial cut away view of a related art flat Braun tube. Referring to FIG. 1, the related art flat Braun tube is provided with a flat panel 1 having three colors of red, green, and blue fluorescent film 4 of a dot type, a shadow mask 3 having a plurality of electron beam pass through holes 3*c* for selective pass of the incident electron beams, a funnel 2 welded to rear of the panel 1, a neck part 2*a* formed in a rear portion of the funnel 2, electron beams(not shown) fitted inside of the neck part 2*a* for emitting electron beams, a deflection yoke 5 around an outer circumference of the funnel 2 for deflecting the electron beams 6, a shadow mask frame assembly 7 for supporting the shadow mask 3, springs 8 fitted to a supporting frame, stud pins 10 coupled with the spring 8 fixed to an inside of the panel 1 for holding the shadow mask frame assembly 7, and an inner shield 9 in rear of the supporting frame 5 for shielding the electron beams 3 from an external geomagnetism in operation of the cathode ray tube for preventing the electron beams from being influenced by the geomagnetism.

Upon putting the flat Braun tube into operation, the electron beams 6 emitted from the electron gun is deflected in a horizontal, or vertical direction by a magnetism of the deflection yoke 5, directed onto the shadow mask 3, pass through the electron beam pass through hole 3*c* in the shadow mask 3 selectively, land on the fluorescent film 4, to form a picture.

FIG. 2 illustrates a perspective view of a shadow mask frame assembly in a related art Braun tube, and FIG. 3 illustrates a shadow mask showing a state of tension applied to the shadow mask, schematically.

Referring to FIGS. 2 and 3, the shadow mask frame assembly 7 in a related art Braun tube is provided with two main frames 7*a* for applying a tension P1 to the shadow mask 3 having fixed opposite ends, two sub-frames 7*b* perpendicular to the main frame 7*a* connected to one ends of the main frames 7*a,* and a thermal compensating plate 11 attached under the sub-frames 7*b*. The shadow mask 3 has an effective surface 3*a* having the electron beam pass through holes 3*c* formed therein, and an edge part 3*b* having no electron beam pass through holes 3*c* formed therein for reinforcing a rigidity of the effective surface 3*a*. The shadow mask frame assembly 7 is designed to have a high rigidity in a structure basis. If a preset tension P1 is provided to the shadow mask 3 by the shadow mask frame assembly 7 having such a high rigidity, a natural frequency of the shadow mask 3 becomes higher, thereby permitting to prevent howling, in which the shadow mask 3 vibrates during operation of the cathode ray tube.

In the meantime, the shadow mask 3 having the preset tension applied thereto by the shadow mask frame assembly 7 is subjected to an elevated temperature process(at approx. 470°). Due to this elevated temperature process, there is a permanent deformation occurred at the shadow mask 3 caused by creep. In the creep, if a constant load is applied to the material for a prolonged time period under a certain temperature, a strain increases as time passes by while the stress on the material is reduced. Therefore, the permanent deformation of the shadow mask caused by the creep becomes the greater as the stress on the shadow mask becomes the greater in the elevated temperature process. At the end, the creep reduces the tension on the shadow mask 3 provided by the frame 7 after the elevated temperature process in comparison to the same before the elevated temperature process, which leads to a poor howling characteristics of the shadow mask 3 during operation of the cathode ray tube, causing a poor color purity by a beam landing error of the electron beams 6. Therefore, in order to reduce the stress relaxation following deformation of the shadow mask 3 caused by the creep during the elevated temperature process, the thermal compensating plate 11 is fitted under the sub-frame 7*b*. FIG. 4 illustrates shadow mask assemblies for showing stresses to the shadow masks from the thermal compensating plate 11 under a room temperature and the elevated temperature, schematically. Referring to FIG. 4, the thermal compensating plate 11 is formed of a material having a thermal expansion coefficient greater than the sub-frames 7*b,* so that the thermal compensating plate 11 makes the sub-frames 7*b* to deform in a "U" form when the thermal compensating plate 11 is heated in the elevated temperature process. This deformation reduces the tension P1 to the shadow mask 3, to reduce the stress on the shadow mask 3, allowing to reduce the stress $\sigma$ on the shadow mask 3 in the elevated temperature process in comparison to the stress a on the shadow mask 3 in the room temperature, which reduces an influence of the creep and deformation caused by the creep. According to this, the tension to the shadow mask 3 can be maintained a state the most close to the tension before the elevated temperature process is carried out even after the elevated temperature process is carried out. At the end, the creep of the shadow mask 3 can be reduced by the thermal compensating plate 11, to reduce the stress relaxation caused by the shadow mask 3 after the elevated temperature process is carried out.

However, though the bimetallic action of the thermal compensating plate 11 in the related art can reduce the influence of creep in the elevated temperature process by deforming the sub-frames 7*b,* there is a problem in that the sub-frames 7*b* are deformed in the "U" form even when the flat Braun tube is in operation as the shadow mask 3 is heated by the electron beam 6, and the heat is transferred to the thermal compensating plate 11. As shown in FIG. 5, this deformation causes a problem of poor color purity of the picture, which deteriorates a reliability of the product, by a beam landing error of the electron beams 6 as the doming in which the shadow mask 3 moves toward the panel is occurred, and the weak tension to the shadow mask 3 deteriorates the howling characteristics.

SUMMARY OF THE INVENTION

Accordingly, the present invention is directed to a frame assembly of a shadow mask in a flat Braun tube that substantially obviates one or more of the problems due to limitations and disadvantages of the related art.

An object of the present invention is to provide a frame assembly of a shadow mask in a flat Braun tube, which can reduce a stress on the shadow mask during an elevated temperature process for minimizing an influence from creep, and compensate for tension reduction of the shadow mask effectively when the flat Braun tube is in operation after the elevated temperature process for minimizing doming, and improve howling characteristics.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the frame assembly of a shadow mask in a flat Braun tube includes a main frame fitted to the shadow mask, sub-frames connected between both ends of the main frame, and a thermal compensating plate fitted to a bottom of the sub-frames, wherein a ratio(h/t) of a height 'h' of the sub-frame to a thickness 't' of the thermal compensating plate is within a range of 4~8.

In another aspect of the present invention, there is provided a frame assembly of a shadow mask in a flat Braun tube including a main frame fitted to the shadow mask, sub-frames connected between both ends of the main frame, and a thermal compensating plate fitted to a bottom of the sub-frames, wherein a ratio(b/b') of a width 'b' of the sub-frame to a width 'b' of the thermal compensating plate is within a range of 0.8~1.3.

In other aspect of the present invention, there is provided a frame assembly of a shadow mask in a flat Braun tube including a main frame fitted to the shadow mask, sub-frames connected between both ends of the main frame, and a thermal compensating plate fitted to a bottom of the sub-frames, wherein a ratio(1/1') of a length 'l' of the sub-frame having the thermal compensating plate fitted thereto to a length 'l'' of the thermal compensating plate is within a range of 0.8~1.3.

In further aspect of the present invention, there is provided a frame assembly of a shadow mask in a flat Braun tube including a main frame fitted to the shadow mask, sub-frames connected between both ends of the main frame, and a thermal compensating plate fitted to a bottom of the sub-frames, wherein a ratio(h/t) of a height 'h' of the sub-frame to a thickness 't' of the thermal compensating plate is within a range of 4~8, a ratio(b/b') of a width 'b' of the sub-frame to a width 'b'' of the thermal compensating plate is within a range of 0.8~1.3, and a ratio(1/1') of a length 'l' of the sub-frame having the thermal compensating plate fitted thereto to a length 'l'' of the thermal compensating plate is within a range of 0.8~1.3.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
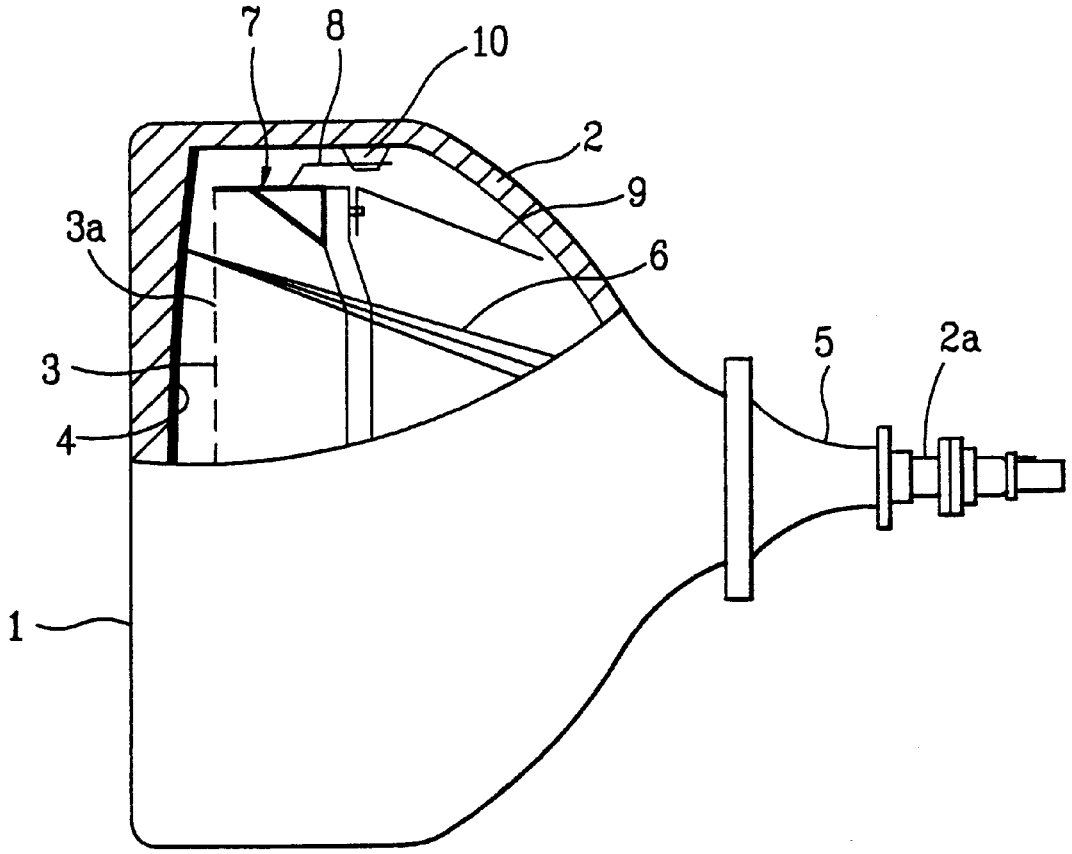
FIG . 1 Prior Art
FIG. 1 illustrates a side view with a partial cut away view of a related art flat Braun tube.
Figure 2:
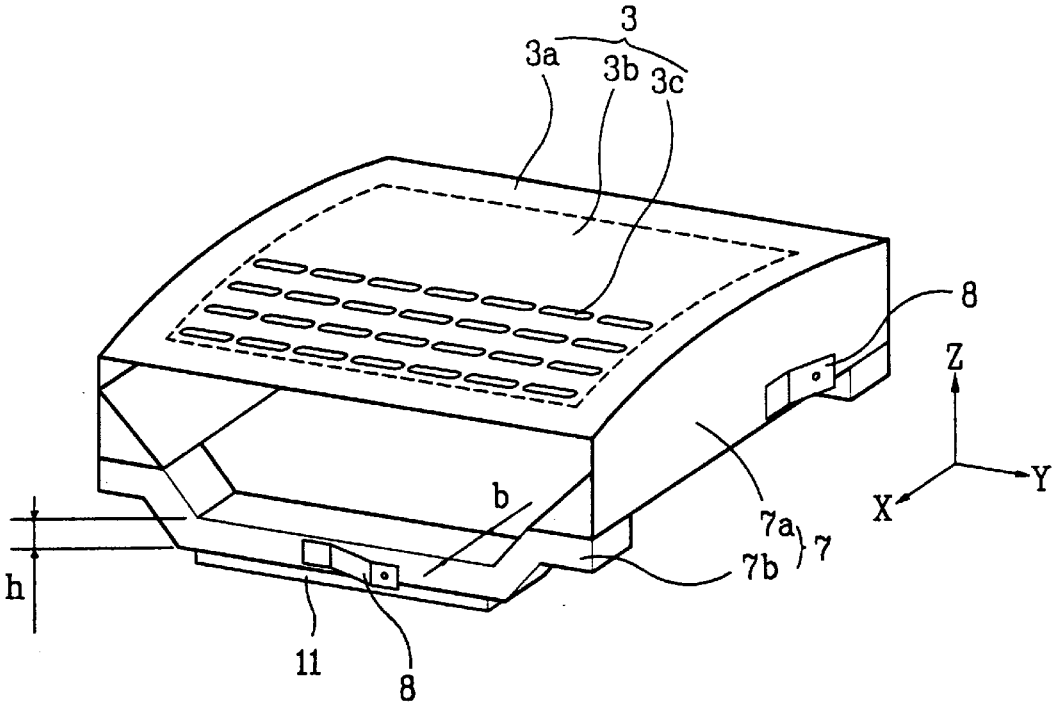
FIG . 2 Prior Art
FIG. 2 illustrates a perspective view of a shadow mask frame assembly in a related art Braun tube.
Figure 3:
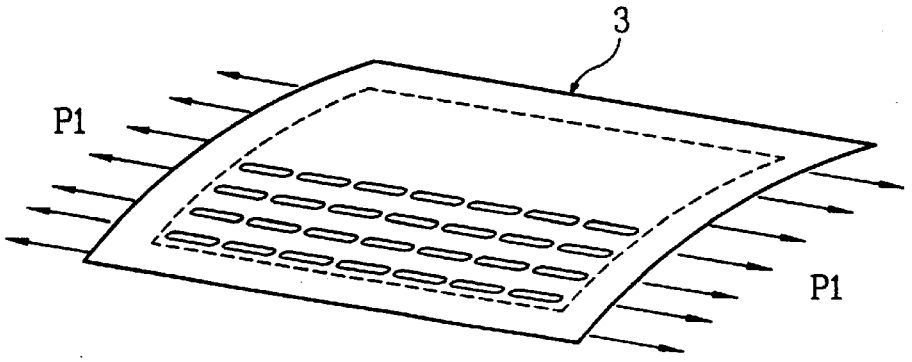
FIG . 3 Prior Art
FIG. 3 illustrates a shadow mask showing a state of tension applied to the shadow mask, schematically.
Figure 4:
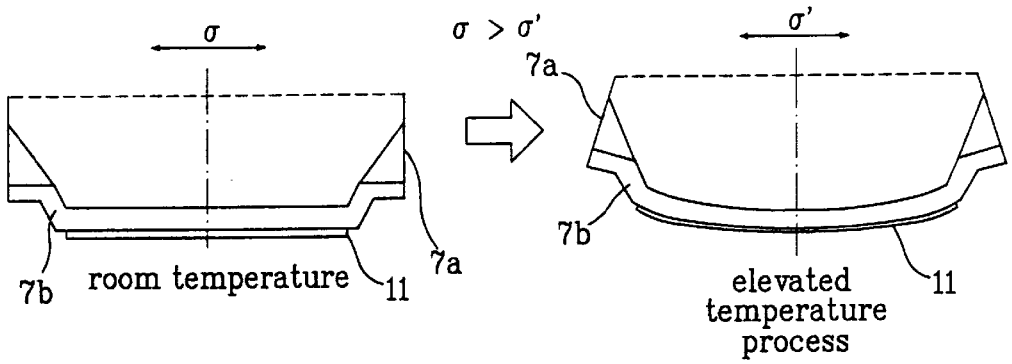
FIG . 4 Prior Art
FIG. 4 illustrates shadow mask frame assemblies for showing stresses on the shadow masks from the thermal compensating plate under a room temperature or elevated temperature, schematically.
Figure 5:
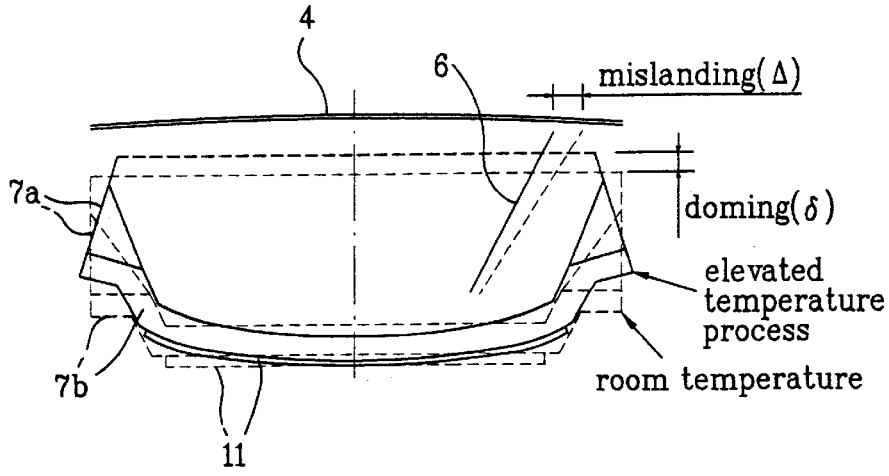
FIG . 5 Prior Art
FIG. 5 illustrates a related art shadow mask frame assembly for showing doming caused by shifting of a shadow mask owing to action of a thermal compensating plate in the related art shadow mask frame assembly, schematically.
Figure 6A:
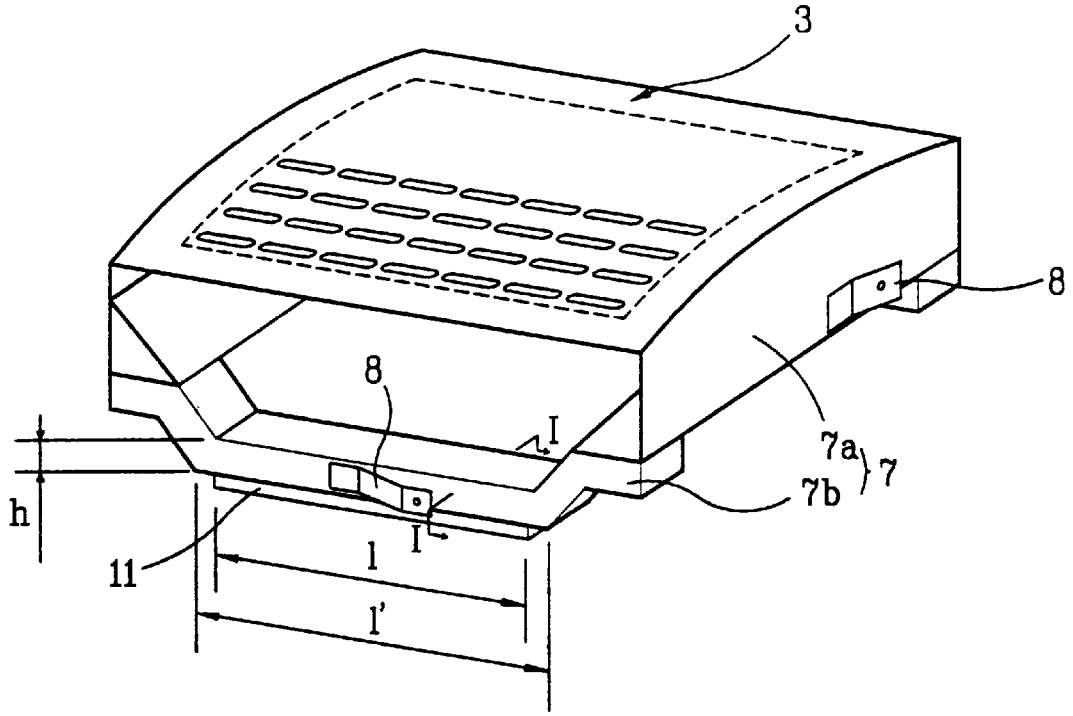
FIG. 6A illustrates a perspective view of a shadow mask frame assembly for explaining shapes and dimensions of sub-frames and a thermal compensating plate.
Figure 7:
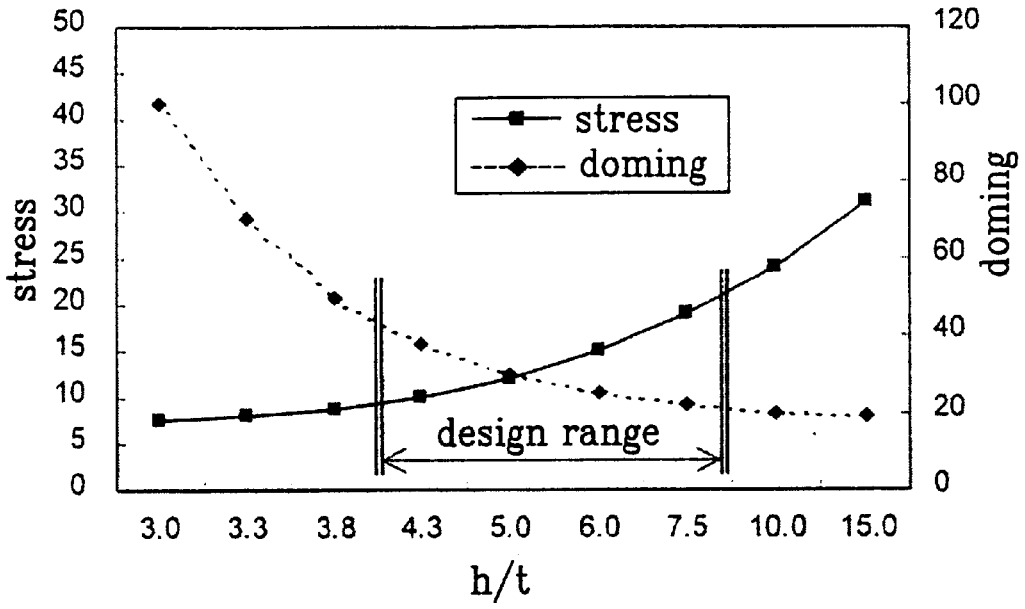
FIG. 7 illustrates a graph showing stress vs. doming characteristics of a shadow mask varied with a ratio of a sub-frame height and a thermal compensating plate thickness.
Figure 8:
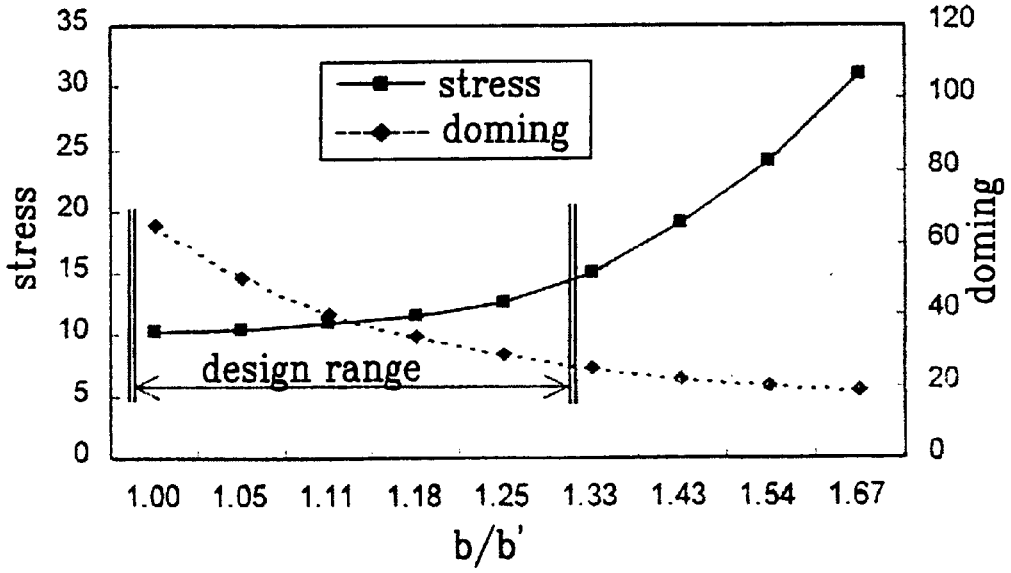
FIG. 8 illustrates a graph showing stress vs. doming characteristics of a shadow mask varied with a ratio of a sub-frame width and a thermal compensating plate width; and, FIG. 9 illustrates a graph showing stress vs. doming characteristics of a shadow mask varied with a ratio of a length of sub-frame width having a thermal compensating plate fitted thereto and a length of the thermal compensating plate.
Figure 9:
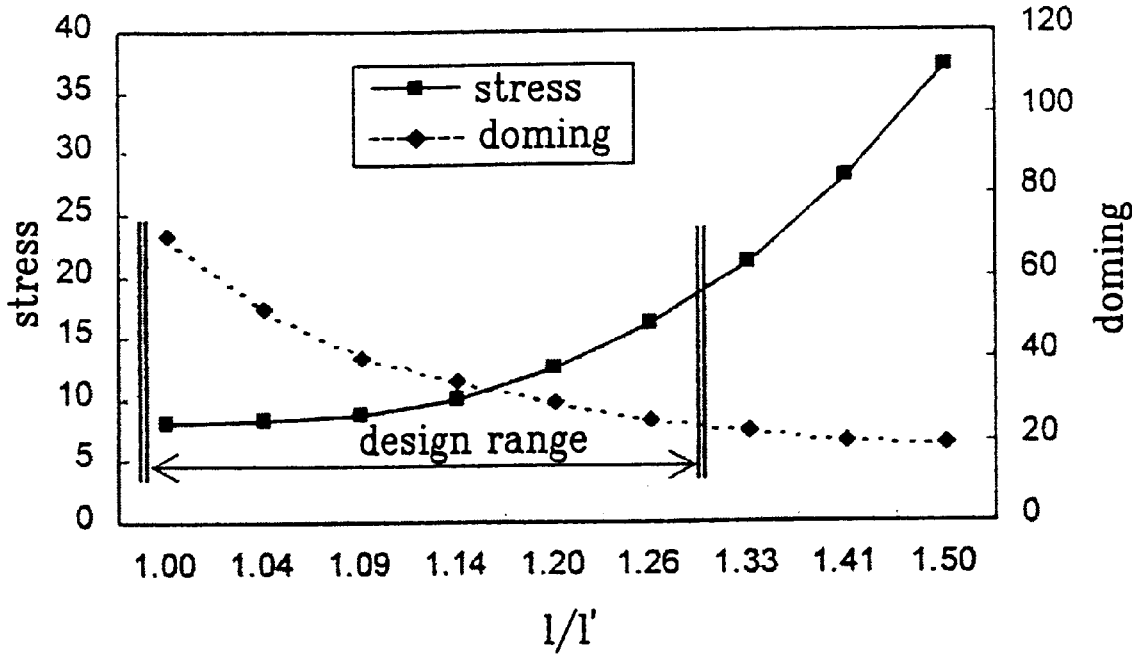

Reference will now be made in detail to the preferred embodiments of the present invention, examples of which are illustrated in the accompanying drawings. FIG. 6A illustrates a perspective view of a shadow mask frame assembly for explaining shapes and dimensions of sub-frames and a thermal compensating plate, FIG. 6B illustrates a section across line I—I in FIG. 6A, FIG. 7 illustrates a graph showing stress vs. doming characteristics of a shadow mask varied with a ratio of a sub-frame height and a thermal compensating plate thickness, FIG. 8 illustrates a graph showing stress vs. doming characteristics of a shadow mask varied with a ratio of a sub-frame width and a thermal compensating plate width, and FIG. 9 illustrates a graph showing stress vs. doming characteristics of a shadow mask varied with a ratio of a length of sub-frame width having a thermal compensating plate fitted thereto and a length of the thermal compensating plate.

Figure 6B:
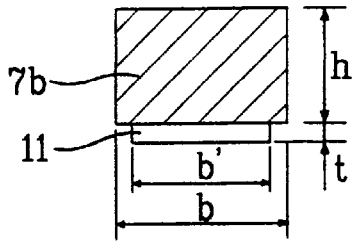
FIG. 6B illustrates a section across line I—I in FIG. 6A.

Referring to FIGS. 6A and 6B, the shadow mask frame assembly in a flat Braun tube of the present invention has a system identical to the related art, inclusive of springs 8 for holding the shadow mask frame assembly 7, a main frame 7*a* for supporting the shadow mask 3, sub-frames 7*b* for serving as an elastic support, and a thermal compensating plate 11 fitted to a bottom of the sub-frames 7*b*, except that the shadow mask frame assembly of the present invention has the sub-frames 7*b* and the thermal compensating plate 11 meeting design criteria which satisfy a characteristic that the creep characteristics in an elevated temperature process is good and there is no beam landing error occurred in operation of the flat Braun tube, if a stress on the shadow mask 3 is below 20 kgf/mm$^2$ in the elevated temperature process and doming of the shadow mask 3 is below 60 $\mu$m in operation of the flat Braun tube. In detail, in the shadow mask frame assembly in a flat Braun tube of the present invention, geometric dimensions of the thermal compensating plate 11 fitted to a bottom of the sub-frames 7*b* for acting as a bimetal and geometric dimensions of the sub-frames 7*b* having the thermal compensating plate 11 fitted thereto are designed specifically.

The shadow mask frame assembly in a flat Braun tube in accordance with a preferred embodiment of the present invention will be explained, with reference to FIGS. 6A~9.

The shadow mask frame assembly in a flat Braun tube in accordance with a preferred embodiment of the present invention includes a frame 7 having a main frame 7*a* with a shadow mask 3 fitted thereto and sub-frames 7*b* connected between both ends of the main frame 7*a*, and a thermal compensating plate 11 fitted to a bottom of the sub-frames 7*b*, wherein a ratio(h/t) of a height 'h' of the sub-frame 7*b* to a thickness 't' of the thermal compensating plate 11 is within a range of 4~8, or alternatively, a ratio(b/b') of a width 'b' of the sub-frame 7*b* to a width 'b'' of the thermal compensating plate 11 is within a range of 0.8~1.3, or alternatively, a ratio(1/1') of a length 'l' of the sub-frame 7*b* having the thermal compensating plate 11 fitted thereto to a length 'l'' of the thermal compensating plate 11 is within a range of 0.8~1.3. As shown in FIGS. 6A and 6B, the thermal compensating plate 11 is a plate with a thickness 't', width 'b'', and a length 'l'', and a thermal expansion coefficient of approx. $1.5\times10^{-5}$~$2.5\times10^{-5}$ of a material readily available, and the sub-frame 7*b* is a bent bar having a section with a height 'h', a width 'b', and a length 'l' having the thermal compensating plate fitted thereto.

The action of the shadow mask frame assembly in a flat Braun tube in accordance with a preferred embodiment of the present invention will be explained.

First, a case when the ratio(h/t) of the height 'h' of the sub-frame 7*b* to the thickness of the thermal compensating plate 11 is varied will be explained.

When the ratio(h/t) of the height 'h' of the sub-frame 7*b* to the thickness of the thermal compensating plate 11 is varied, a stress in the elevated temperature process and an amount of doming in operation of the flat Braun tube are also varied. In detail, the greater the ratio(h/t) of the height 'h' of the sub-frame 7*b* to the thickness of the thermal compensating plate 11, the greater the stress on the shadow mask 3, and the greater the stress, the poorer the creep characteristic, which can be confirmed in FIG. 7. Opposite to this, it can be also confirmed that the greater the ratio(h/t), the smaller the bimetal effect, which reduces an amount of doming of the shadow mask 3 in operation of the flat Braun tube. Accordingly, design criteria can be calculated, which can satisfy both the stress in the elevated temperature process and the amount of doming in operation of the flat Braun tube, which bring about opposite results. The ratio(h/t) of the height 'h' of the sub-frame 7*b* to the thickness of the thermal compensating plate 11, which can satisfy both characteristics, is 4~8, which can be confirmed in FIG. 7. That is, when the ratio(h/t) of the height 'h' of the sub-frame 7*b* to the thickness of the thermal compensating plate 11 is within a range of 4~8, the stress on the shadow mask 3 is below 20 kgf/mm$^2$ in the elevated temperature process and doming of the shadow mask 3 is below 60 $\mu$m in operation of the flat Braun tube, thereby permitting to obtain excellent creep characteristics in the elevated temperature process and prevent occurrence of a beam landing error in operation of the flat Braun tube.

Second, a case the ratio(b/b') of a width 'b' of the sub-frame 7*b* to a width 'b'' of the thermal compensating plate 11 is varied will be explained, with reference to FIG. 8.

Alikely, in this case too, the stress and the amount of doming are reversely proportional to variation of the ratio (b/b') of a width 'b' of the sub-frame 7*b* to a width 'b'' of the thermal compensating plate 11. In more detail, when the ratio(b/b') of a width 'b' of the sub-frame 7*b* to a width 'b'' of the thermal compensating plate 11 is within a range of 0.8~1.3, the stress on the shadow mask 3 is below 20 kgf/mm$^2$ in the elevated temperature process and the amount of doming of the shadow mask 3 is below 60 $\mu$m in operation of the flat Braun tube, thereby permitting to obtain excellent creep characteristics in the elevated temperature process and prevent occurrence of a beam landing error in operation of the flat Braun tube.

Third, a case the ratio(1/1') of a length 'l' of the sub-frame 7*b* having the thermal compensating plate 11 fitted thereto to a length 'l'' of the thermal compensating plate 11 is varied will be explained, with reference to FIG. 9.

Alikely, in this case too, the stress and the amount of doming are reversely proportional to variation of the ratio (1/1') of a length 'l' of the sub-frame 7*b* having the thermal compensating plate 11 fitted thereto to a length 'l'' of the thermal compensating plate 11. In more detail, when the ratio(1/1') of a length 'l' of the sub-frame 7*b* having the thermal compensating plate 11 fitted thereto to a length 'l'' of the thermal compensating plate 11 is within a range of 0.8~1.3, the stress on the shadow mask 3 is below 20 kgf/mm$^2$ in the elevated temperature process and the amount of doming of the shadow mask 3 is below 60 $\mu$m in operation of the flat Braun tube, thereby permitting to obtain excellent creep characteristics in the elevated temperature process and prevent occurrence of a beam landing error in operation of the flat Braun tube.

Of course, the object of the present invention explained before can be achieved even in a case the dimensions of the sub-frames and the thermal compensating plate are designed such that the ratio(h/t) of a height 'h' of the sub-frame 7*b* to a thickness 't' of the thermal compensating plate 11 is within a range of 4~8, a ratio(b/b') of a width 'b' of the sub-frame 7*b* to a width 'b'' of the thermal compensating plate 11 is within a range of 0.8~1.3, and a ratio(1/1') of a length 'l' of the sub-frame 7*b* having the thermal compensating plate 11 fitted thereto to a length 'l'' of the thermal compensating plate 11 is within a range of 0.8~1.3.

Thus, the frame assembly of a shadow mask in a flat Braun tube of the present invention can provide design criteria for the sub-frames 7*b* and the thermal compensating plate 11 which permits to deal with the creep problem occurred in the elevated temperature process effectively and also satisfy doming characteristics. According to this, the stress relaxation of the shadow mask 3 caused by the creep in the elevated temperature process is minimized and the doming and tension reduction of the shadow mask 3 caused by a heat in operation of the flat Braun tube can be prevented.

As has been explained, the frame assembly of a shadow mask in a flat Braun tube of the present invention has the following advantages.

By optimizing ratios of heights and widths of the sub-frames and the thermal compensating plate, and the length ratio of the sub-frame having the thermal compensating plate fitted thereto to the thermal compensating plate, the tension on the shadow mask is reduced in the elevated temperature process, to minimize an influence of the creep, and the reduction of the tension of the shadow mask is compensated effectively in operation of the flat Braun tube, thereby improving the doming which causes a beam landing error and deterioration of a color purity caused by howling.

It will be apparent to those skilled in the art that various modifications and variations can be made in the frame assembly of a shadow mask in a flat Braun tube of the present invention without departing from the spirit or scope of the invention. Thus, it is intended that the present invention cover the modifications and variations of this invention provided they come within the scope of the appended claims and their equivalents.

What is claimed is:

1. A frame assembly of a shadow mask in a flat Braun tube comprising:

a main frame fitted to the shadow mask;

sub-frames connected between both ends of the main frame; and, a thermal compensating plate fitted to a bottom of the sub-frames, wherein a ratio(h/t) of a height 'h' of the sub-frame to a thickness 't' of the thermal compensating plate is within a range of 4~8.

2. A frame assembly of a shadow mask in a flat Braun tube comprising:

a main frame fitted to the shadow mask;

sub-frames connected between both ends of the main frame; and, a thermal compensating plate fitted to a bottom of the sub-frames, wherein a ratio(b/b') of a width 'b' of the sub-frame to a width 'b'' of the thermal compensating plate is within a range of 0.8~1.3.

3. A frame assembly of a shadow mask in a flat Braun tube comprising:

a main frame fitted to the shadow mask;

sub-frames connected between both ends of the main frame; and, a thermal compensating plate fitted to a bottom of the sub-frames, wherein a ratio(l/l') of a length 'l' of the sub-frame having the thermal compensating plate fitted thereto to a length 'l'' of the thermal compensating plate is within a range of 0.8~1.3.

4. A frame assembly of a shadow mask in a flat Braun tube comprising:

a main frame fitted to the shadow mask;

sub-frames connected between both ends of the main frame; and, a thermal compensating plate fitted to a bottom of the sub-frames, wherein a ratio(h/t) of a height 'h' of the sub-frame to a thickness 't' of the thermal compensating plate is within a range of 4~8, a ratio(b/b') of a width 'b' of the sub-frame to a width 'b'' of the thermal compensating plate is within a range of 0.8~1.3, and a ratio(l/l') of a length 'l' of the sub-frame having the thermal compensating plate fitted thereto to a length 'l'' of the thermal compensating plate is within a range of 0.8~1.3.

* * * * *